US009808912B2

(12) United States Patent
Sang et al.

(10) Patent No.: US 9,808,912 B2
(45) Date of Patent: Nov. 7, 2017

(54) METHOD FOR FABRICATING SUPER MIRROR FINISH STAINLESS STEEL DECORATIVE SHEET

(71) Applicant: HAIMEN SENDA DECORATION MATERIAL CO., LTD, Nantong (CN)

(72) Inventors: Zhihong Sang, Nantong (CN); Liang Hong, Nantong (CN); Hui Jiang, Nantong (CN); Gang Chen, Nantong (CN)

(73) Assignee: HAIMEN SENDA DECORATION MATERIAL CO., LTD, Nantong (CN)

( * ) Notice: Subject to any disclaimer, the term of this patent is extended or adjusted under 35 U.S.C. 154(b) by 0 days.

(21) Appl. No.: 14/548,913

(22) Filed: Nov. 20, 2014

(65) Prior Publication Data

US 2015/0266335 A1 Sep. 24, 2015

(30) Foreign Application Priority Data

Mar. 18, 2014 (CN) ..... 2014 1 0101481

(51) Int. Cl.
*B24B 1/00* (2006.01)
*B24D 11/00* (2006.01)
*B24B 7/00* (2006.01)

(52) U.S. Cl.
CPC ..... *B24D 11/005* (2013.01); *B24B 1/00* (2013.01); *B24B 7/00* (2013.01)

(58) Field of Classification Search
CPC ..... B24B 7/00; B24B 21/008; B24B 27/0076; B24B 1/00
See application file for complete search history.

(56) References Cited

U.S. PATENT DOCUMENTS 5,931,722 A * 8/1999 Ohmi ..... B24B 37/04 451/271
6,203,403 B1 * 3/2001 Odstrcil ..... B24B 29/02 451/28
2006/0278536 A1 * 12/2006 Burrell ..... G01N 27/26 205/775
2011/0275284 A1 * 11/2011 Leidolf, Jr. ..... B05D 5/067 451/28
2012/0309273 A1 * 12/2012 Popov ..... B24D 15/023 451/57
2013/0220821 A1 * 8/2013 Cho ..... C25D 1/04 205/122

FOREIGN PATENT DOCUMENTS

CN 201010286999.2 5/2011

* cited by examiner

*Primary Examiner* — Timothy V Eley
(74) *Attorney, Agent, or Firm* — Treasure IP Group, LLC.

(57) ABSTRACT

The present invention provides a method for fabricating a super mirror finish stainless steel sheet uses the following steps: 1) rough machining, wherein a 400-450 grit sandpaper or scouring pad is used to remove an oxide layer on a surface of a stainless steel decorative sheet; 2) finish machining, wherein a 240-1,000 grit graphite grinding wheel is used to perform finish grinding; and 3) polishing processing, wherein an abrasive material is used to perform polishing. For the finish grinding and the polishing that are performed by using the grinding wheel and the abrasive material respectively, a multi-shaft polishing system is used to drive a grinding wheel, and a cylinder is controlled to adjust a force of each polishing shaft, which enables a stainless steel decorative sheet to have a surface finish under 0.01 μm and a reflectivity above 69%.

3 Claims, No Drawings

METHOD FOR FABRICATING SUPER MIRROR FINISH STAINLESS STEEL DECORATIVE SHEET

CROSS REFERENCE TO RELATED APPLICATION

This application claims priority to Chinese Application No. 2014101014815, filed on Mar. 18, 2014. The Chinese Application is incorporated herein by refrence in its entirety.

FIELD OF THE INVENTION

The present invention relates to fabrication of a mirror finish stainless steel decorative sheet.

BACKGROUND OF THE INVENTION

CN201010286999.2 provides a method and an apparatus for grinding a surface of a stainless steel sheet, which includes a process of transferring a stainless steel sheet to under a circular abrasive belt grinding head by using pinch rollers, and a process of grinding a surface of the stainless steel sheet by using the circular abrasive belt grinding head. The process of grinding the surface of the stainless steel sheet by using the circular abrasive belt grinding head includes supporting a bottom roller by using one or two supporting rollers, supporting and transferring the stainless steel sheet by using the bottom roller, and grinding or polishing the stainless steel sheet on the bottom roller by using the circular abrasive belt grinding head. However, a stainless steel decorative sheet mentioned in the prior art has a surface finish that is around 0.02 μm and a reflectivity that is less than 62%, which is still insufficient for a decorative effect in terms of optical energy. Existing equipment transfers a material in a mechanical manner at a constant speed; an optical rotation texture of the surface of the decorative sheet is uneven; and a surface finish has deviations that are observable by naked eyes.

SUMMARY OF THE INVENTION

An objective of the present invention is to provide a method for processing a surface of a 2B or BA stainless steel sheet, which enables a stainless steel decorative sheet to have a surface finish under 0.01 μm and a reflectivity above 69%, so as to achieve a unique decorative effect in terms of optical energy.

The technical solution of the present invention is that, a method for fabricating a super mirror finish stainless steel sheet uses the following steps: 1) rough machining, where a 400-450 grit sandpaper or scouring pad is used to remove an oxide layer on a surface of a stainless steel decorative sheet; 2) finish machining, where a 240-1,000 grit graphite grinding wheel is used to perform finish grinding; and 3) polishing processing, where an abrasive material is used to perform polishing. For the finish grinding and the polishing that are performed by using the grinding wheel and the abrasive material respectively, a multi-shaft polishing system is used to drive a grinding wheel, and a cylinder is controlled to adjust a force of each polishing shaft, so as to make a super mirror finish stainless steel decorative sheet by abrasion.

In a process in which the stainless steel decorative sheet is transferred, a soft and elastic sponge roller is used as a top roller to prevent sheet surfaces from being damaged by pressing, where a damage of the sheet surface affects surface quality.

A recipe of the abrasive material that is used for the polishing processing is: adding 5-8 kg aluminum oxide into 1,000 kg water, and then adding 20 kg oxydol. The aluminum oxide is classified according to grain sizes into those of 2,000 grits, 4,000 grits, 6,000 grits, and the like, where a larger size produces a larger abrasive force.

Further, a polishing force is controlled by controlling a force between a polishing drive shaft and a polishing wheel, where a digital force sensor is installed for a display purpose, and a multi-shaft automatic force numerical control apparatus is used.

Beneficial effects of the present invention are that: an improvement is made on a transferring manner of a transferring conveyor for grinding and polishing, an improvement is made on a manner in which existing equipment transfers a material mechanically at a constant speed, and a Siemens direct current scheduling apparatus and a Mitsubishi PLC controller are converted into a high-precision grinding and polishing automatic control device. Product quality is greatly improved by the above improvements. Unevenness of an optical rotation texture of the surface of the decorative sheet and deviations that are observable by naked eyes on the surface finish are eliminated. Certainly, the following effects are further achieved by the recipe of the abrasive material and an improvement on a process:

1) product color is uniform, and no deviation that is observable by naked eyes is available;
2) a product surface is even and free from defects such as scratches, creases, dents, and oil stains;
3) a roughness is under 0.01 μm; and
4) a reflectivity is above 69% (meeting a product standard of quasi-optical reflection).

The present invention can be used to fabricate an article of extremely high quality, thereby filling a gap in the stainless steel decoration industry. A product of the present invention can directly improve quality of products of downstream industries, particularly, quality of electrical devices and kitchen products, so that the products of electrical devices and kitchen products produced in China may reach an advanced level of similar products outside China.

DETAILED DESCRIPTION OF THE EMBODIMENT

Steps of the present invention are as follows: 1) rough machining, where a 400-450 grit sandpaper, for example, a 400 grit scouring pad, is used to remove an oxide layer on a surface of a stainless steel sheet; 2) finish machining, where a 240-1,000 grit graphite grinding wheel, particularly, an 800-1,000 graphite grinding wheel, is used to perform processing, so that "hills" on the surface are smoothed; and then polishing is performed by using an abrasive material.

Polishing is performed by using a multi-shaft system, and a cylinder is used to adjust a force of each polishing shaft, so that each polishing shaft of the multi-shaft system has the same force, and each grinding wheel driven by each polishing shaft has the same abrasive force. This enables surface quality of a mirror finish sheet that is made by abrasion to achieve an ideal state. Polishing equipment is modified, where a digital force sensor (Toledo) is installed between a polishing drive shaft and a polishing wheel. A multi-shaft automatic force numerical control apparatus ("Toledo" 8424B force numerical-controlled instrument) is used, and a force meter is used for display purpose. Then, adjustment is made so that the abrasive force of each grinding wheel is the same (forces displayed by the force numerical-controlled instrument are the same). The force of the polishing shaft is manually adjusted because a difference between polishing forces directly affects surface polishing quality of the decorative sheet.

A recipe of the abrasive material that is used for the polishing processing is: adding 5-8 kg aluminum oxide into 1,000 kg water, and then adding 20 kg oxydol. The aluminum oxide is classified according to grain sizes into those of 2,000 grits, 4,000 grits, 6,000 grits, and the like. The aluminum oxide of these grits may all be used, while a larger grain size produces a larger abrasive force. Certainly, a smaller grain size produces a better condition, and an abrasive duration is more than 10 minutes.

In a transferring process, a soft and elastic sponge roller is used as a top roller to prevent sheet surfaces from being damaged by pressing, where a damage of the sheet surface affects surface quality.

A Siemens direct current scheduling apparatus, a Mitsubishi PLC controller, and a "Toledo" 8424B force numerical-controlled instrument are converted into a high-precision grinding and polishing automatic control device. Product quality is greatly improved by using the above improvements.

The invention claimed is:

1. A method for fabricating a super mirror finish stainless steel sheet, comprising the following steps:

1) performing rough machining on a 2B or BA stainless stell sheet, by using a 400-450 grit sandpaper or scouring pad to remove an oxide layer on a surface of the stainless steel sheet;

2) performing finish machining on the stainless steel sheet from step 1), by using a 240-1,000 grit graphite grinding wheel to perform finish grinding;

3) performing polishing processing on the stainless steel sheet from step 2), by using an abrasive material slurry together with polishing wheels, wherein the stainless steel sheet from step 2) is subject to a multi-shaft polishing system, and each polishing shaft drives a polishing wheel, and a cylinder is used to adjust pressure for each polishing shaft in the multi-shaft polishing system, so that all shafts are driven under a same pressure and have equal polishing force 4) obtaining a super mirror finish stainless steel sheet, having a surface finish under 0.01 μm and a reflectivity about 69%.

2. The method according to claim 1, further comprising transferring the stainless steel sheet in steps 1)-3) between rollers, and using a soft and elastic sponge roller as a top roller.

3. The method according to claim 1 wherein the abrasive material slury is made by the following method steps:

adding 5-8 kg of aluminum oxide into 1,000 kg water, and then adding 20 kg oxydol to the aluminum oxide mixture;

wherein the grain size of the aluminum oxide is selected from 2,000 grits, 4,000 grits, and 6,000 grits.

* * * * *